US006778154B2

(12) United States Patent
Van Velzen

(10) Patent No.: US 6,778,154 B2
(45) Date of Patent: Aug. 17, 2004

(54) DISPLAY DEVICE

(75) Inventor: Jeroen Van Velzen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 191 days.

(21) Appl. No.: 09/790,347

(22) Filed: Feb. 21, 2001

(65) Prior Publication Data

US 2001/0030633 A1 Oct. 18, 2001

(30) Foreign Application Priority Data

Feb. 24, 2000 (EP) ..... 00200638

(51) Int. Cl.[7] ..... G09G 3/30
(52) U.S. Cl. ..... 345/76; 345/80; 345/77

(58) Field of Search ..... 345/82–83, 76, 345/77, 78, 79, 80

(56) References Cited

U.S. PATENT DOCUMENTS 5,552,677 A * 9/1996 Pagones ..... 315/169.1
5,719,589 A * 2/1998 Norman et al. ..... 345/82
5,723,950 A 3/1998 Wei et al. ..... 315/169.3
5,903,246 A * 5/1999 Dingwall ..... 345/82
6,369,786 B1 * 4/2002 Suzuki ..... 345/77

* cited by examiner

*Primary Examiner*—Steven Saras
*Assistant Examiner*—Ming-Hun Liu

(57) ABSTRACT

Rise time in matrix_LED displays is decreased by providing extra current via capacitive (37) of column electrodes (12) to a circuit (39) providing peak currents.

19 Claims, 2 Drawing Sheets

DISPLAY DEVICE

Figure 1:
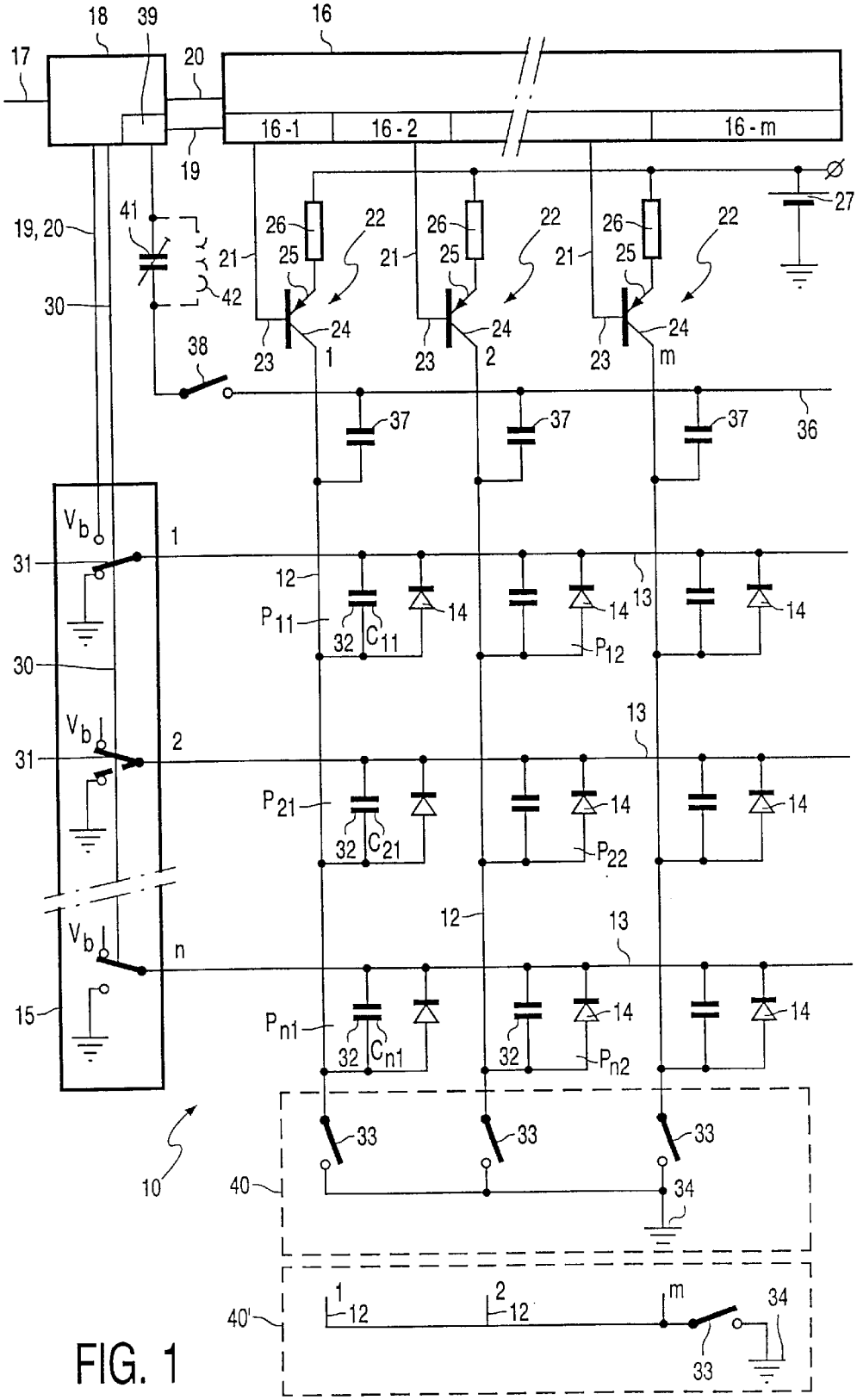

The invention relates to a display device comprising an electroluminescent material between a first pattern of row—or selection—electrodes and a second pattern of column—or data—electrodes, at least one of the two patterns being transparent to the radiation to be emitted, the electrodes, together with the intermediate electroluminescent material, forming part of pixels at overlap locations of said electrodes, the device comprising a drive circuit which can supply a selected pixel with a substantially constant current during use.

Display devices of this type (matrices of organic LEDs, polymer LEDs) find an increasingly wider application in, for example, mobile telephones.

A problem in the drive of such matrices of organic LEDs is the capacitance associated with each LED, which capacitance is formed by the overlapping electrodes and the interpositioned layer(s) of organic material, as well as the capacitance of the drive leads. This is a problem because the LEDs are usually driven by means of current drive. A large part of the initial current which should actually flow through the relevant LED charges the capacitance associated with the LED so that the LED conveys too little current and consequently emits light initially at a too low luminance level. For larger matrices, the capacitance and the resistance of the drive leads also play a role and, due to long RC times, the desired setting level during a writing period cannot be achieved in some cases.

It is an object of the present invention to provide a solution to the above-mentioned problem.

To this end, a display device according to the invention is characterized in that a plurality of column electrodes is capacitively coupled to an electrode which is coupled to a voltage source via a switch. The voltage source is suitable for supplying a voltage jump.

By supplying at least one voltage jump in the forward direction of the LED during a selection period, the total capacitance associated with all LEDs in the relevant row can be rapidly charged in the desired direction so that the current through one (or more) LED(s) is very rapidly defined substantially exclusively by the associated current source(s). The voltage jump is preferably supplied directly at the start of the selection period.

With the aid of the same capacitive coupling, it is also possible to supply a voltage jump of opposite sign by the end of the selection period, so that the total capacitance associated with all LEDs in the relevant row is rapidly discharged or provided with such a charge that the LEDs which are no longer selected are reverse biased.

In this respect it is to be noted that U.S. Pat. No. 5,723,950 describes a similar principle for accelerating the adjustment of the LEDs in the forward direction. However, an extra circuit is provided for each column, which circuit comprises, inter alia, an operational amplifier with associated resistors and a capacitor. This leads to an unwanted number of extra components, even when such a precharge circuit is used for a group of two or more columns. Moreover, the drive transistor for each column must be able to supply the extra current determined by the precharge circuit; the transistors of the column driver must thus be designed for higher currents than those required for actual use. Since this usually requires extra space in the realization in an integrated circuit, these circuits become more expensive.

These and other aspects of the invention are apparent from and will be elucidated with reference to the embodiments described hereinafter.

Figure 2:
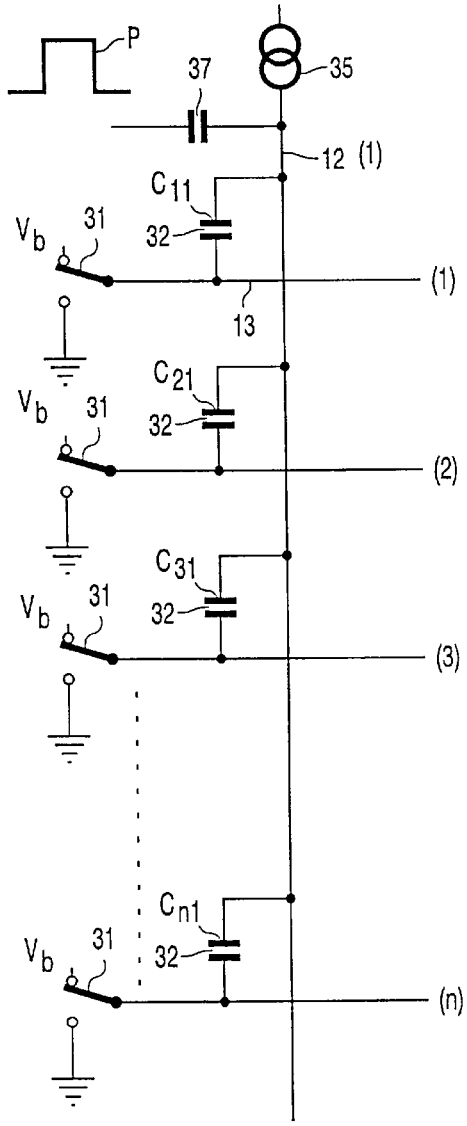
Figure 3:
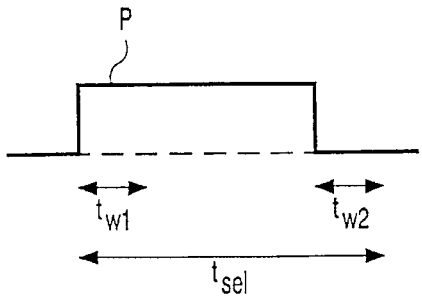

In the drawings:

FIG. 1 shows diagrammatically a display device according to the invention, while FIG. 2 shows diagrammatically a part of this display device, with reference to which the problem of initial charging is dealt with, and FIG. 3 shows the voltage variation on the electrode.

The Figures are diagrammatic; corresponding components are generally denoted by the same reference numerals.

FIG. 1 is an equivalent circuit diagram of a part of a display device 10 according to the invention. It comprises a matrix of (O) LEDs 14 with n rows (1, 2, . . . , n) and m columns (1, 2, . . . , m). This device further comprises a row selection circuit 15 (for example, a multiplex circuit 15 which connects the row electrodes either to ground or to a voltage $V_b$ via a drive line 30 and switches 31 in this example) and a data register 16. Externally presented information 17, for example a video signal, is processed in a processing unit 18 which, dependent on the information to be displayed, charges the separate parts 16-1, 16-2, . . . 16-m of the data register 16 via supply lines 19, such that the bases 23 of transistors 22 (in this example pnp transistors) are provided with a voltage related to this information via the lines 21. In this embodiment, the actual column conductors 12 are connected in an electrically conducting manner to the collectors 24 of the transistors 22, while the emitters 25 of these transistors are connected via resistors 26 to a fixed voltage, in this embodiment a voltage of +10 V via a voltage source 27 which is connected to ground. The choice of the resistors 26, which have a substantially identical resistance, and of the voltages supplied by the register 16 to the bases 23 are chosen to be such in this example that a combination of a transistor 22 and a resistor 26 can be considered to be a substantially ideal current source. However, the relevant current source can only convey current when this current can be drained via the collector. To this end, the voltage at a row electrode 13 must be sufficiently low. The relevant row selection voltages are presented by the row selection circuit 15. Mutual synchronization between the selection of the rows and the presentation of voltages on the lines 21 takes place by means of the drive unit 18 via drive lines 20, 30. Moreover, all column electrodes can be connected to a reference voltage, in this example to ground potential 34 via switches 33, for example transistors, to be further described.

In a conventional drive mode, all information for a line to be driven is first stored in the data register 16. Subsequently, the row electrode 13 associated with the line, in this example the electrode associated with line 1 is selected. To this end, the relevant switch 31 is connected to ground and, dependent on the voltages on the lines 21, currents will start flowing in the current sources associated with line 1 and consequently in the LEDs.

As described in the opening paragraph, a capacitance 32 constituted by the overlapping electrodes and the interpositioned layer(s) of organic material is associated with each LED. The effect of this capacitance will now be described with reference to FIG. 2 in which only the associated capacitances $C_{11}$, $C_{21}$, $C_{31}$ and $C_{n-1}$ are shown for column 1. Although only the phenomena in column 1 are described, this description is representative of the events taking place in the full matrix of pixels.

The current source described above with reference to the transistor 22 and the resistor 26 is denoted by the reference numeral 35. During selection of a row of LEDs, the row electrode 13 is connected to ground via switch 31. After termination of a selection period, denoted by $t_{sel}$ in FIG. 3, and during the period of non-selection, the row electrode 13 is connected via switch 31 to a voltage $V_b$ which is chosen to be such that the LEDs do not conduct at the usual currents and voltages in the current source 22 and on the columns 13 because these LEDs are reverse-biased. The LEDs 14 conduct, for example, from a forward voltage of, for example, about 1.5 volts. To adjust grey values, a range of forward voltages of between 1.5 and 3 volts is sufficient. In practice, the voltage at the column electrodes may be up to 15 volts due to, for example, resistance effects and dependent on the drive mode. At a reverse voltage of, for example 2 volts across the LEDs, a negligible leakage current occurs. In this example, 15 volts is chosen for $V_b$.

Simultaneously with (or immediately after) the selection of the row 1, the current sources 35 are activated via the separate parts 16-1, 16-2, . . . 16-m of the data register 16, so that these current sources start conveying current. The current from current source 35 in FIG. 2 is, however, mainly used for charging the capacitances $C_{11}$, $C_{21}$, $C_{31}$ and $C_{n1}$. For the total current I, it approximately holds that $I=C.\Delta V/\Delta t=\Sigma C_{i1}.\Delta V/\Delta t$, with i=1 . . . n. After a time Δt, the voltage across the capacitances (and hence that across $C_{11}$ and the associated LED) is $\Delta V=I.\Delta t/C$. At a high value of C, i.e. at an intrinsically high capacitance or in the case of many rows, it is possible that the desired voltage level is not reached within a selection period $t_{sel}$ and the LED emits light having the wrong intensity.

To prevent this, the device 1O has an extra electrode line 36 which constitutes a plurality of capacitances 37 together with a suitable dielectric and the column electrodes 12. For example, the layer of luminescent material provided with an extra dielectric may function as a dielectric. Via a switch 38, a voltage jump (via a pulse P) is presented from a voltage source 39 which forms part of the processing unit 18 in this example (FIG. 3). The voltage source 39, the pulse height of P and the capacitances 37 are dimensioned in such a way that the capacitances 32 are charged via this extra voltage pulse within a time $t_{w1}$ which may be considerably shorter than the selection period, and this to such an extent that the diode associated with $C_{11}$ almost starts conducting or almost reaches the effective range. As soon as the forward voltage is reached during selection of the LED, this LED starts conducting and will emit the desired light level by virtue of the current adjusted by the current source 35. After selection, the LEDs are reverse-biased as described hereinbefore. This means that, to prevent unwanted emission in the row of LEDs which has just been switched off, but also to prevent a parasitic current, the capacitances $C_{11}$, $C_{21}$, $C_{31}$ and $C_{n1}$ must be discharged at least before selection of the next row to a level at which no light is emitted. At the end of the selection period, the LEDs are therefore short-circuited, as it were, by connecting the column electrodes to ground via a switch (transistor) 33, preferably after the pulse P has dropped off, for example, during a time $t_{w2}$ (FIG. 3). The switches (transistors) 33 (block 40 in FIG. 1) are also driven from the processing unit (drive unit) 18 via drive lines (not shown). The switches (transistors) 33 may also be formed as one single switch (transistor) 33 (block 40' in FIG. 1).

The display device of FIG. 1 further comprises a capacitor 41. Although this is not strictly necessary for functioning of the display device as described hereinbefore, such a capacitor, if, for example, adjustable, may be used to vary the pulse P as presented to the LEDs, for example, initially because the capacitances 32, 37 are process-dependent, or during use (in the course of the lifetime of the display device) because the characteristics change due to ageing. An inductance (coil) 40 may also be arranged parallel to this capacitor. The resonant circuit thus obtained is then used to temporarily store energy required for switching by means of the pulses P so that the voltage source 39 needs to supply less energy.

Several variations are possible within the scope of the invention. For example, the pulse pattern (P) capacitively induced on a column electrode may also be presented to the two ends of the column electrode. This is notably advantageous in larger matrices because the pulses are distorted due to the capacitance and the resistance of the column electrodes. If necessary, the pulse P may be presented a little later, provided that there is sufficient time left to supply all LEDs with the desired forward voltage within $t_{sel}$. Particularly when a high value of the capacitances 32 is desired, a different dielectric may alternatively be chosen such as, for example, silicon nitride. The capacitances 32 may also be realized as separate capacitances or formed as one integrated circuit together with the registers 15, 16, the transistors 22 and the processing unit 18. Instead of bipolar transistors 22, use may be made of MOS transistors.

The protective scope of the invention is not limited to the embodiments described. The invention resides in each and every novel characteristic feature and each and every combination of characteristic features. Reference numerals in the claims do not limit the protective scope of a claim. The use of the verb "to comprise" and its conjugations does not exclude the presence of elements other than those stated in the claims. The use of the article "a" or "an" preceding an element does not exclude the presence of a plurality of such elements.

What is claimed is:

1. A display device, comprising:

a selection electrode;

a data electrode overlapping said selection electrode;

an electroluminescent material between the overlap of said selection electrode and said data electrode to form a pixel;

a selection circuit electrically coupled to said selection electrode and a driving circuit electrically coupled to said data electrode, said selection circuit and said driving circuit for supplying said pixel with a current during a selection time period;

a charging electrode overlapping said data electrode;

a dielectric material between the overlap of said data electrode and said charging electrode to form a capacitor; and a charging circuit electrically coupled to said charging electrode, said charging circuit for charging said capacitor during the selection time period.

2. The display device of claim 1, wherein said charging circuit commences a charging of said capacitor at a start of the selection time period.

3. The display device of claim 1, wherein said charging circuit includes:

a switch electrically coupled to said charging electrode;

a capacitor electrically coupled to said switch; and a voltage source electrically coupled to said capacitor.

4. The display device of claim 1, wherein said charging circuit includes:

a switch electrically coupled to said charging electrode;

an inductor electrically coupled to said switch; and a voltage source electrically coupled to said inductor.

5. The display device of claim 1, wherein said charging circuit includes:

a switch electrically coupled to said charging electrode;

a voltage source; and a capacitor and an inductor electrically coupled in to parallel to said switch and said voltage source.

6. The display device of claim 1, wherein said electroluminescent material is a semiconducting organic material.

7. The display device of claim 1, wherein said electroluminescent material includes an active layer; and wherein at least one of said selection electrode and said data electrode injects a plurality of electrons into said active layer.

8. A display device comprising:

a selection electrode;

a data electrode overlapping said selection electrode;

an electroluminescent material between the overlap of said selection electrode and said data electrode to form a pixel;

a selection circuit electrically coupled to said selection electrode and a driving circuit electrically coupled to said data electrode, said selection circuit and said driving circuit for supplying said pixel with a current during a selection time period;

a charging electrode overlapping said data electrode;

a dielectric material between the overlap of said data electrode and said charging electrode to form a capacitor;

a charging circuit electrically coupled to said charging electrode, said charging circuit for charging said capacitor during the selection time period; and a switching circuit electrically coupled to said data electrode, said switching circuit for discharging said capacitor subsequent to the charging of said capacitor by said charging circuit.

9. The display device of claim 8, wherein said charging circuit commences a charging of said capacitor at a start of the selection time period.

10. The display device of claim 8, wherein said switching circuit commences a discharging of said capacitor during the selection time period.

11. The display device of claim 8, wherein said switching circuit commences a discharging of said capacitor after the selection time period.

12. The display device of claim 8, wherein said switching circuit commences a discharging of said capacitor at an end of the selection time period.

13. The display device of claim 8, wherein said charging circuit includes:

a switch electrically coupled to said charging electrode;

a capacitor electrically coupled to said switch; and a voltage source electrically coupled to said capacitor.

14. The display device of claim 8, wherein said charging circuit includes:

a switch electrically coupled to said charging electrode;

an inductor electrically coupled to said switch; and a voltage source electrically coupled to said inductor.

15. The display device of claim 8, wherein said charging circuit includes:

a switch electrically coupled to said charging electrode;

a voltage source; and a capacitor and an inductor electrically coupled in to parallel to said switch and said voltage source.

16. The display device of claim 8, wherein said switching circuit includes a switch electrically coupled to said data electrode.

17. The display device of claim 8, further comprising a common reference; and wherein said switching circuit includes a switch electrically coupled to said data electrode and said common reference.

18. The display device of claim 8, wherein said electroluminescent material is a semiconducting organic material.

19. The display device of claim 8, wherein said electroluminescent material includes an active layer; and wherein at least one of said selection electrode and said data electrode injects a plurality of electrons into said active layer.

* * * * *